US005360101A

United States Patent [19]

Carlen

[11] Patent Number: 5,360,101

[45] Date of Patent: Nov. 1, 1994

[54] GRIPPER CONVEYOR

[75] Inventor: Bo Carlen, Sollentuna, Sweden

[73] Assignee: Idab Wamac AB, Eksjo, Sweden

[21] Appl. No.: 31,404

[22] Filed: Mar. 15, 1993

[30] Foreign Application Priority Data

Mar. 16, 1992 [SE] Sweden ..... 9200797

[51] Int. Cl.[5] ..... B65G 47/86

[52] U.S. Cl. ..... 198/803.7; 198/470.1

[58] Field of Search ..... 198/470.1, 803.7, 803.9; 294/104, 116; 271/82, 85, 204–206

[56] References Cited

U.S. PATENT DOCUMENTS

| | | | |
|---|---|---|---|
| 3,204,756 | 9/1965 | Lesch | 198/803.7 X |
| 3,269,524 | 8/1966 | Canfield | 198/803.7 |
| 4,381,056 | 4/1983 | Eberle | 198/803.7 |
| 4,921,294 | 5/1990 | Klopfenstein | 198/803.7 X |
| 4,982,834 | 1/1991 | Jacobsén | 198/803.7 |
| 5,064,187 | 11/1991 | Müller | 198/803.7 X |
| 5,178,262 | 1/1993 | Merkli et al. | 198/470.1 X |

FOREIGN PATENT DOCUMENTS 0356521 5/1988 European Pat. Off. .

*Primary Examiner*—James R. Bidwell

*Attorney, Agent, or Firm*—Keck, Mahin & Cate

[57] ABSTRACT

A gripper conveyor includes a moving conveyor chain (1) which is provided with grippers (3). Each of the grippers (3) includes a fixed clamping jaw (31), a pivotal clamping jaw (33) and a spring (36) which biases the grippers (3) towards their closed positions. The conveyor includes an opening means (40) which functions to open selected grippers (3) while the conveyor chain moves, and the pivotal clamping jaw (33) of respective grippers (3) has a maneuvering arm (37) which is activated by the opening means (40). The movable clamping jaw (33) is pivotally mounted on a shaft (32) for limited, free pivotal movement in the pivoting direction. Because the center of gravity (331) of the movable clamping jaw (33) is distanced from the shaft (32) the movable jaw (33) is able to swing downwardly and outwardly into abutment with the support surface (N1, N11) on which the article, for instance a newspaper, to be gripped lies. Optionally, the outward swinging movement of the movable jaw (33) is assisted by a spring (35). The maneuvering arm (37) may be arranged to swing outwardly away from the movable jaw (33) after having reached its end position in the gripping direction.

12 Claims, 3 Drawing Sheets

Fig. 7
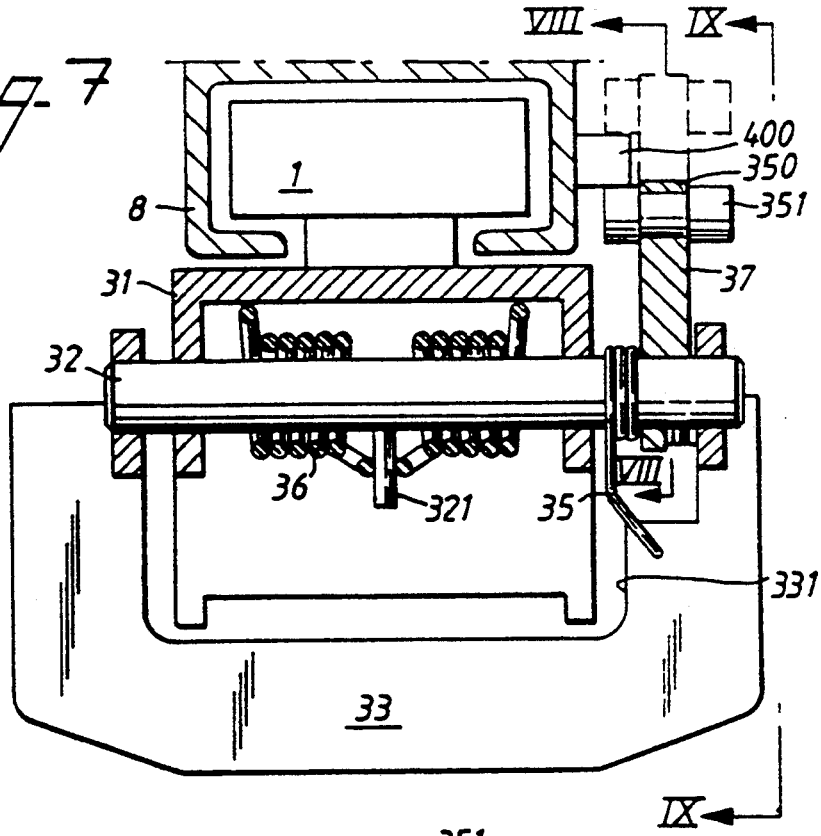
Fig. 8
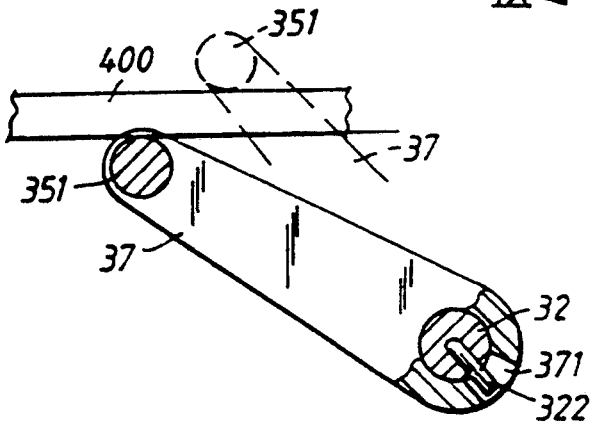
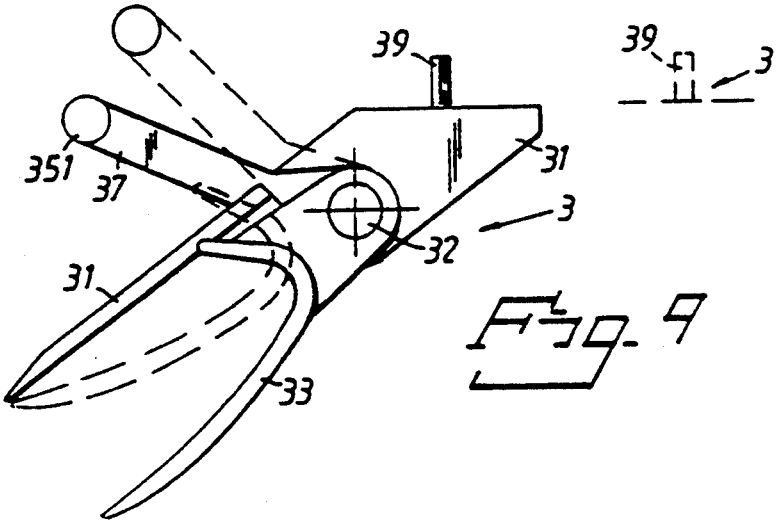
Fig. 9

GRIPPER CONVEYOR

FIELD OF THE INVENTION

The present invention relates to a gripper conveyor of the kind which includes a circumferentially extending conveyor chain which is provided with grippers each of which includes a fixed clamping jaw, a pivotally movable clamping jaw and a spring means which permanently biases the gripper towards a closed position, and which further includes gripper opening means which function to open a selected gripper as the conveyor chain moves, wherein the movable clamping jaw of the gripper has a maneuvering arm which is by the gripper opening means to swing the movable clamping jaw against the action of the spring means.

BACKGROUND OF THE INVENTION

Gripper conveyors of the aforesaid kind are known to the art and are often used to pick-up, in a given position, newspapers or like flat articles which are conveyed in mutually overlapping relationship on a conveyor path and for releasing transported newspapers and like flat articles at another position along the chain. It should be mentioned here that the term "newspaper" as used in this document is meant to include any type of printed matter and like flat articles.

The grippers are opened and the gripper conveyor is controlled in a manner such that the free edge of the movable clamping jaws will engage in the overlapping stream, wherewith the next following newspaper in the stream will move into the open gripper due to a difference in speed between the newspaper stream and the gripper conveyor.

In order to limit the complexity of the gripper conveyor and to ensure that the grippers will function effectively, particularly with regard to manufacturing costs, it has been suggested to use grippers of the aforedescribed, i.e. grippers which are permanently spring-biased towards a closed position.

The grippers are opened by activating the movable clamping jaw with the aid of the maneuvering arm, by causing the manouvering arm to run on a guide bar or rail such as to swing the manouvering arm, wherein the length of the bar determines the time period over which the gripper is held open. When the gripper opens, the free edge of the movable clamping jaw is swung down to a given level determined by the level of said guide bar. In the open position of the gripper, the level on which the free edge of the movable clamping jaw is located will correspond to the level of the exposed upper surface of a newspaper in the overlapping newspaper stream on the conveyor path. This causes problems related to the varying levels of the upper surfaces of respective newspapers, for instance as a result of varying thickness of the newspapers or like publications, the varying extent to which the newspapers overlap, and so on. This problem is accentuated when the conveyor is stopped and also at the end of a stream of mutually overlapping newspapers.

Publication EP 0 356 521 teaches a conveyor which includes grippers which are highly complex, insofar as the movable clamping jaw/clamping jaws of the gripper include a pivot journal and a latching mechanism between their driving end and their clamping end. The latching mechanism is brought to a clamping jaw latching state and a clamping jaw releasing state by means other than the means used to open the gripper against the action of a spring force. Furthermore, this known gripper is not permanently biased towards a closed gripper position, and the movable clamping jaw moves rectilinearly against the action of the spring means.

SUMMARY OF THE INVENTION

Consequently, one object of the present invention is to provide a solution to the problem encountered in conveyors which include grippers that have a low degree of complexity.

This object is achieved with an inventive gripper conveyor having the characteristic features set forth below.

According to one embodiment of the invention, the movable clamping jaw or jaws shall be mounted in a manner to obtain a clearance in relation to the manouvering arm in the direction of pivotal movement, so that the movable clamping jaw is able to move freely through a limited pivot angle from the dogging position in the closing direction in relation to the manouvering arm subsequent to activating the arm to open the gripper jaw, so that the movable clamping jaw will abut the surface of the newspaper stream with a low abutment force and within a given distance range between the free edge of the fixed clamping jaw and the surface on which the free edge of the movable clamping shall rest when gripping a newspaper.

According to another embodiment of the invention, a relatively weak spring is provided for activating the movable clamping jaw in an opening direction, so as to enable the movable clamping jaw to be quickly opened subsequent to activation of the manouvering arm. Thus, because of the relatively weak spring it is not necessary to rely solely on gravity to effect opening of the clamping jaw so as to cause the movable clamping jaw to pivot in an opening direction relative to the manouvering arm.

The relatively weak spring may be constructed so that its opening force will decrease proportionally to the outward swinging movement of the movable clamping jaw such that this swinging movement is initially very quick while the force with which the clamping jaw lies against the stream of newspapers will nevertheless be relatively small. Thus, when the stream of newspapers passes generally horizontally beneath the forwardly moving row of grippers, it can suffice to allow gravity to ensure that the movable clamping jaw will be swung out, by placing the center of gravity of the movable clamping jaw at a distance from the pivot point of the movable clamping jaw. However, this outward swinging movement can be made more certain with the aid of the aforesaid relatively weak spring, which also permits the movable clamping jaw to swing outwards in other gripper orientations.

In the case of the inventive gripper construction, as far as it has been described hitherto, the position of the manouvering arm end from the movement path of the fixed gripper clamping jaws will vary in accordance with the thickness of the newspaper that has been gripped. This may constitute a problem when opening the gripper to release the newspaper. Consequently, according to a further development of the invention the manouvering arm presents a clearance to the pivotal clamping jaw in the pivoting direction, and a relatively weak spring is provided for biasing the manouvering arm to an outwardly swung, outer end position which is preferably always the same irrespective of the thickness of a newspaper gripped by the gripper. In this case, the aforesaid relatively weak spring is conveniently the same spring as that beforementioned which functions to bias the pivotally journalled clamping jaw outwards into abutment with the surface on which the newspaper to be gripped rests.

The conventional method for opening a gripper of a conveyor of the kind to which the invention refers is to allow the gripper manouvering arm to move forwards into contact with a stationary rail or bar, so that the manouvering arm is swung down and the movable clamping jaw is able to swing away from the fixed clamping jaw.

If only one gripper is to be opened with the aid of one such rail, a problem arises relating to the fact that a conveyor of the aforesaid kind may have a gripper spacing of about 50 mm and a conveying capacity of, for instance, 60,000 copies per hour. It will be understood that the bar may be inserted into the movement path of the gripper manouvering arms and therewith be in contact with said arm only for a very short period of time (before the next gripper manouvering arm arrives and is activated by the bar). During this short period of time at disposal for activating an individual gripper manouvering arm, there is no time for the newspaper to fall out of the gripper. It has therefore been suggested that the jaw opening means shall include activating devices which are each capable of activating a manouvering arm so as to open the gripper concerned, wherein the activating devices are caused to accompany the gripper in its movement over a distance of such length (a period of such duration) that the newspaper will actually have time to fall from the gripper. The inventive gripper construction in which the end of the manouvering arm is sprung back to a position which lies at a considerable distance transversely to the gripper chain from the position it occupied when the gripper grasped a newspaper, irrespective of the thickness of the newspaper, enables another alternative opening means to be used. This alternative opening means includes a long bar which holds an opened gripper open along a conveying distance which is greater than the distance between mutually adjacent grippers. A shoulder on the end of the gripper manouvering arm can always pass on one side of the single, long bar, since the end of the manouvering arm is always returned to said outer position, so as to exclude the risk of the shoulder colliding with the upstream end of the bar when the newspaper concerned has considerable thickness. The alternative opening means also includes means which function to move the end of the manouvering arm of an individual gripper to the open gripper position, so as to enable the shoulder on the end of the manouvering arm to move forwards into contact with the other side of the long bar and to slide along this other side, such as to hold the gripper open along the full length of this long bar. The shoulder on the end of the manouvering arm passes free at the downstream end of the bar, so as to close the gripper automatically. The aforesaid means may, for instance, include a plunger which is movable transversely to the direction of movement of the grippers, or a flap which is pivotally mounted on the upstream end of the bar and pivotal into and away from the path of the shoulders on the ends of respective manouvering arms, so as to enable these shoulders either to pass freely on one side of the bar or to cause the shoulders to slide up into abutment with the other side of the bar and therewith open the gripper and hold the gripper open along the length of the long bar. The aforesaid means, for instance, in the form of a plunger or a flap, should, of course, have a small length in the direction of movement of the conveyor, for instance, a height which is smaller than the division between the grippers, so as to enable one gripper to be opened without disturbing the following grippers.

As will be understood, the opening means may be constructed to enable a few newspapers, for instance, one particular section of the newspapers or each alternate newspaper or each third newspaper in the newspaper stream or the like to be gripped, and may, of course, also be constructed to open all grippers.

The means for opening an individual gripper prior to guiding the gripper into geared coaction with the long bar may include a circumferentially extending conveyor belt having mounted thereon controllable dogging elements which can be moved selectively to an active position in which they coact with a selected gripper, said actuator conveyor belt moving in generally the same direction and at generally the same speed as the conveyor chain of the gripper conveyor in the gripper opening region. The actuators may, for instance, include pins which are axially displaceable in hollow shafts which connect the links of the actuator conveyor chain, wherein a plunger moves a selected pin to its operative position, while the extended pins are returned to their inoperative position by a wedge-shaped ramp subsequent to their coaction with a gripper. The invention will now be described in more detail with reference to exemplifying embodiments thereof and also with reference to the accompanying drawings, in which

BRIEF DESCRIPTION OF THE DRAWINGS

FIG. 7 is a sectional view of a gripper embodiment at present preferred; and FIGS. 8 and 9 are views taken on the line VIII and XI respectively in FIG. 7.

DETAILED DESCRIPTION OF THE PREFERRED EMBODIMENTS

An inventive gripper conveyor may typically include an endless, driven conveyor chain which is guided for movement in a channel profile and which carries grippers mounted at uniform distances apart along the chain. Mounted at selected positions along the chain path are gripper opening devices which enable the grippers to open so as to grip and to release articles, such as newspapers or like publications.

Figure 1A:
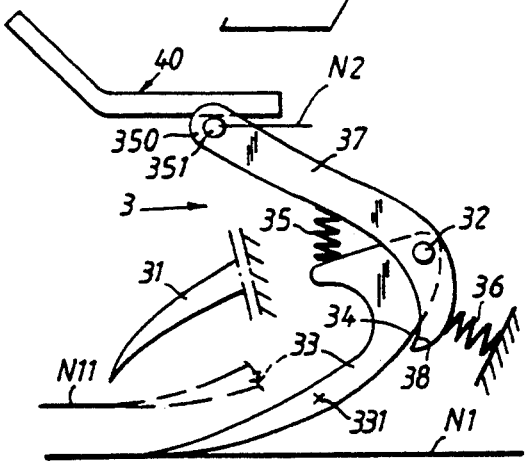
FIGS. 1A and 1B illustrate schematically a first embodiment of a gripper forming part of the inventive conveyor.

Referring to FIG. 1A, it is assumed that a stream of mutually overlapping newspapers (as hereinbefore defined) rest on a level N1 corresponding to the level of a conveyor belt which moves to the right in FIG. 1A at a speed which is slightly greater than the speed at which the gripper 3, shown in FIG. 1A, moves to the right in said Figure.

As will be seen from FIG. 1A, the gripper 3 comprises a fixed gripper jaw 31 which carries a movable clamping jaw 33 on a shaft 32. The fixed jaw 31 is assumed to be permanently connected to a link of the conveyor chain. A gripper manouvering arm 37 is pivotally mounted on the shaft 32 and has an end-part/-lower part 38 which functions to dog the movable clamping jaw 33 in the closing direction of the gripper. The free end 350 of the manouvering arm 37 is provided with a pin 351 which is able to coact with a guide cam 40.

The center of gravity 331 of the movable clamping jaw 33 lies at a horizontal distance from the shaft 32, so that the clamping jaw is able to swing towards a gripping position under the influence of gravity, when the gripper is located in a horizontal chain section. The gripper includes a powerful closing spring 36 which drives the movable clamping jaw 33 towards its closed position through the agency of the end-part 38 of the manouvering arm.

In order to assist opening of the jaw 33 in the gripper open state, the jaw 33 is acted upon by a relatively weak spring 35 which engages at a distance from the shaft 32 and supports, for instance, against the manouvering arm 37. As a result of the spring 35, the movable jaw 33 is moved out towards its abutment surface, i.e. the surface of a newspaper stream or conveyor even in other gripper orientations.

FIG. 1A illustrates two different positions for the free edge of jaw 33, namely the level N1 and the level N11 respectively. It is conceivable for the level N1 to correspond to the upper surface of a conveyor on which a forwardly moving stream of newspapers lie in mutually overlapping relationship, and for the level N11 to correspond to the upper surface of this stream of newspapers. It will be understood that the inventive construction of the gripper enables its movable gripping jaw 33 also to take a correct position for gripping a newspaper in said stream at the beginning of the stream and in the proximity of a discontinuation in the stream, irrespective of the thickness of the newspapers in said stream.

Figure 1B:
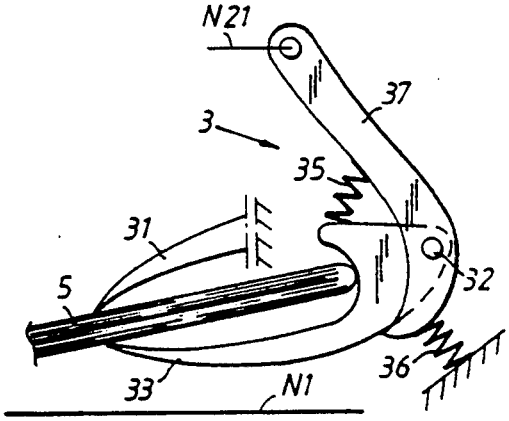

In the FIG. 1B illustration, the gripper 3 is shown gripping a newspaper 5 whose thickness defines the level N21 of the pin 351 on the manouvering arm 37. When the thickness of the newspaper 5 corresponds essentially to the distance between the level N1 and the free edge of the fixed jaw 31, the level N21 in FIG. 1B will approach the level N2 in FIG. 1A. This implies a limitation with regard to the mechanisms that can be used for opening the grippers.

Figure 2A:
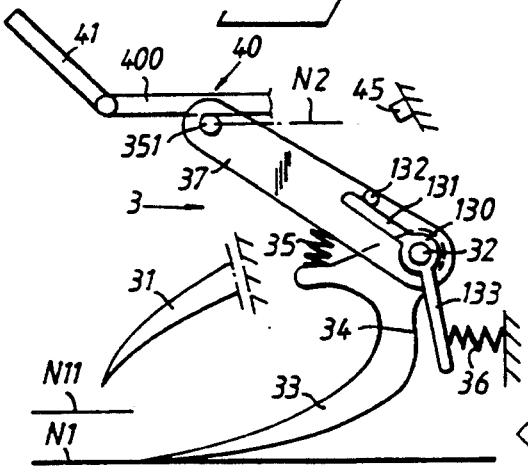
FIGS. 2A and 2B illustrate schematically a second embodiment of the gripper.

Referring now to FIG. 2A, it will be seen that the shaft 32 carries a pivotally journalled dogging/double-arm lever 130, one arm 131 of which coacts with an abutment 132 on the manouvering arm 37 and the other arm 133 of which coacts with an outer counterpressure surface 34 on the pivotal clamping jaw 33. The spring 35 acts between the movable clamping jaw 33 and the manouvering arm 37. The gripper 3 is opened by the coaction of the arm with the cam 40, in the same way as in FIG. 1A, in that the abutment 132 causes the lever 130 to be swung anticlockwise and enable the jaw 33 to swing downwards under the combined influence of the force of gravity and the force exerted by the spring 35.

Figure 2B:
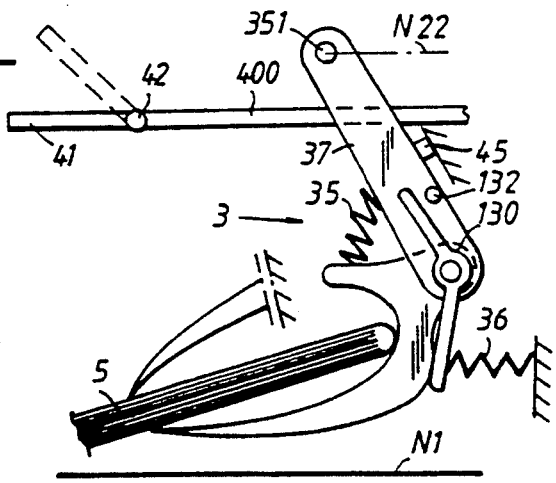

Turning now to FIG. 2B, it will be seen that when the gripper 3 is closed by means of the spring 36, the spring 35 has swung the maneuvering arm 37 to one side in a clockwise direction, so that the abutment 132 is distanced from the lever leg 131 through a given angle, such as to establish a predetermined distance between the levels N22 and N2 for the pin 351 transversely to the gripper conveyor chain, even when the thickness of the gripped article 5 reaches a maximum value, so that the pin 351, if so desired, is able to pass on the upper side of a bar 400 corresponding to the horizontal leg of the cam 40 in the FIG. 2A illustration. In this way, the sloping leg 41 of the cam 40 can be hinged by a pivot 42 and be displaceable to a horizontal position, shown in FIG. 2B, to enable the gripper 3 to pass without being opened. Restoring movement of the manouvering arm 37 is limited to a given position, which can be defined with the aid of a fixed stop 45.

Figure 3:
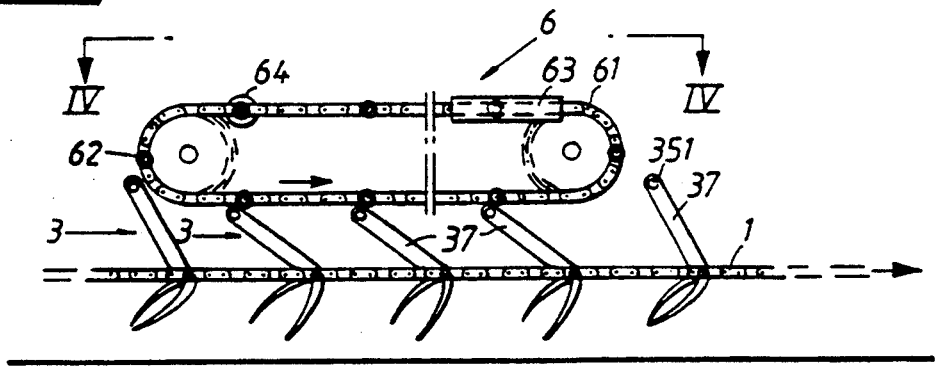
FIGS. 3 and 4 illustrate schematically an inventive conveyor, in side view and in horizontal view respectively.
Figure 4:
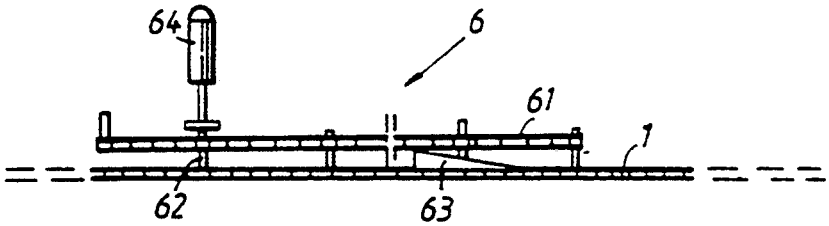

Referring now to FIG. 3, it will be seen that an opening means for the grippers on the conveyor chain 1 may include an endless chain 61 of which the upper part, or run, moves parallel with the chain 1 along a chosen distance which is greater than the spacing of the grippers on the chain 1. Referring to FIG. 4, it will be seen that the links of the chain 61 are coupled through the agency of hollow shafts in which pins 62 are axially movable. Mounted along the upper run of the chain 61 is a wedge ramp 63 which functions to return the pins 62 to one end position. Also provided is a plunger arrangement 64 which functions to selectively move pins 62 to their other end position. The link shafts of the chain 61 have a division or pitch corresponding to the division or pitch of the grippers 3 on the chain 1, and the chain 61 moves synchronously with the chain 1, so that pins 62 driven out by the plunger 64 will come into engagement with the end 35 of the manouvering arm (the pin 351) on the grippers 3 and open the gripper, wherein the outwardly moved pins 62 move together with the gripper and hold the gripper open along the lower part or bottom run of the chain 61, without causing an obstruction to the forward upstream or downstream grippers 3.

Figure 5:
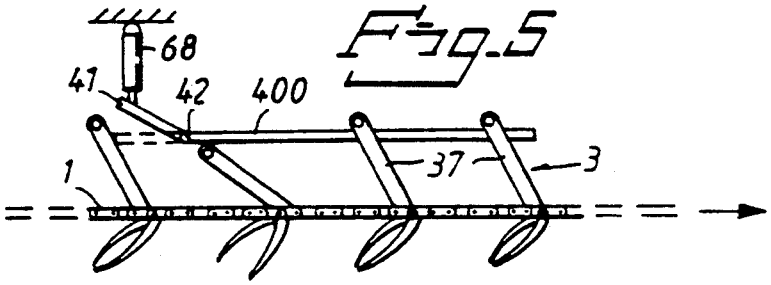
FIG. 5 illustrates the coaction between a gripper according to FIG. 2 and an opening means which can be used with the gripper according to FIG. 2 irrespective of the gripper width.

FIG. 5 illustrates schematically the opening means indicated in FIGS. 2A, 2B. As will be seen, the opening means includes a stationary bar 400 which extends parallel with the chain 1 along a distance which is greater than the distance between mutually adjacent grippers, i.e. the gripper spacing. A flap 41 is pivotally mounted on a pivot journal 42 at the upstream end of the bar 400. The flap 41 is pivoted by means of a piston-cylinder device 68 between a position in which the flap 42 forms a camming surface which functions to open an arriving gripper, and a position in which the flap 41 lies in line with the bar 400 and thus enables the pins 351 to pass on the upper side of the flap 42 and the bar 400. The length of the flap 41 is shorter than the spacing between the grippers on the chain 1.

Figure 6:
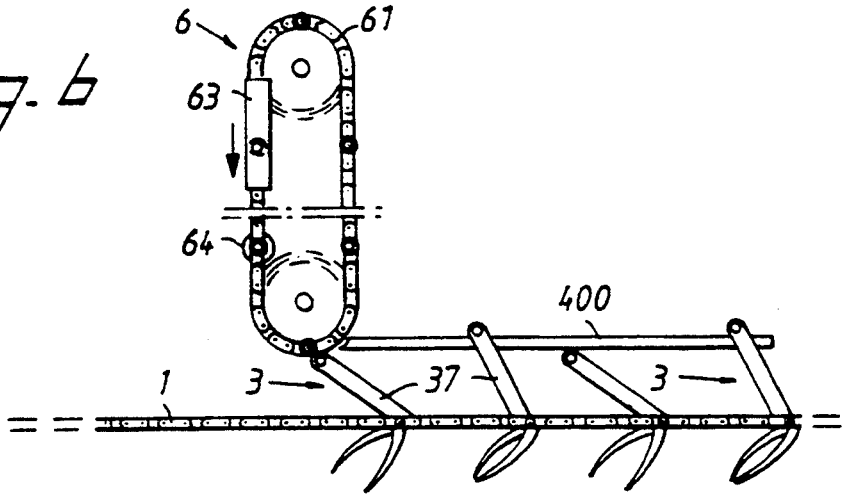
FIG. 6 illustrates schematically another opening means for an inventive gripper conveyor.

FIG. 6 illustrates an embodiment of an opening means which although based on the construction illustrated in FIG. 5 has a circumferentially extending opening means 6 which is fully analogous with the construction illustrated in FIG. 5, instead of the pivotal flap 41 and its piston-cylinder drive device 68.

With reference to FIGS. 5 and 6, it will be seen that it is important that the end 35 of the gripper manouvering arm is swung up to a level which is in line with the upper side of the bar 400, subsequent to gripping a newspaper 5 and irrespective of the thickness of the gripped newspaper 5.

The embodiment illustrated in FIGS. 7–9 includes a chain guide rail 8 which guides the links of the chain 1, which in turn are fixedly mounted on the fixed clamping jaw 31 carrying the rotatable shaft 32 and the movable clamping jaw 33 fixedly connected to said shaft. The shaft 32 is provided with a radial pin 321 which forms an attachment point for the double coil spring 36 whose ends bear against the fixed clamping jaw 31.

The manouvering arm 37 is journalled for rotation on the shaft 32 and has a sector-shaped recess 371 (FIG. 8) which receives a radial pin 322 on the shaft 32.

The sector angle of the recess 371 of the arm 37 is such that the arm illustrated. in FIG. 8 is able to swing clockwise after the gripper jaws 31, 33 have been brought together with a newspaper gripped therebetween or in the absence of a newspaper, whereby the pin 351 can be moved transversely to the direction of the chain 1 through at least a distance which corresponds to the thickness of the bar 400, even though the gripping width between the jaws 31, 33 has been fully utilized.

FIG. 9 illustrates the gripper in a fully opened position and in a fully closed position. It will be seen that the short division, indicated in FIG. 9 by the pins 39 connecting the grippers to the chain 1, implies a risk that the movable jaw 33 on a following gripper will strike against the free edge of the fixed jaw 31 of a preceding gripper, and consequently the movable clamping jaws 33 are provided with a central recess 331 which is able to accommodate the free edge of the fixed jaw 31 of the preceding gripper.

It is claimed:

1. A gripper conveyor comprising a moving conveyor chain (1) which is provided with grippers (3) each including a fixed clamping jaw (31), a pivotable clamping jaw (33) and a spring means (36) which functions to bias the grippers towards a closed state, and an opening means (6, 41, 42, 68) for opening selected grippers (3) as the conveyor chain (1) moves, wherein the pivotable jaw (33) of the grippers (3) is connected to a maneuvering arm (37) which can be swung by the opening means to its open position in a direction such as to dog the pivotable clamping jaw towards its open position against the action of the spring means, wherein at said open position of the maneuvering arm the pivotable clamping jaw (33) is mounted on a pivot in order to be substantially freely swingable on the pivot in order to drop to the open state of the gripper and for limited pivotal movement in relation to the pivotal maneuvering arm (37) in the open state of the gripper; and wherein means (331; 35) are provided for driving the movable clamping jaw (33) towards its outer end position in the opening actuating state of the maneuvering arm (37).

2. A gripper conveyor according to claim 1, comprising means (371, 372) for defining an end position for pivotal movement of the maneuvering arm in a direction away from the movable clamping jaw; and further comprising a biasing means (35) which is weaker than the spring means (36) and which biases the maneuvering arm (37) in a direction towards said end position.

3. A gripper conveyor according to claim 1 wherein the movable jaw drive means (331) includes locating a center of gravity of the movable clamping jaw (33) at a horizontal distance from a pivot axis (32) of the movable jaw (33); and wherein the grippers move over a stream of articles that are to be gripped by the grippers.

4. A gripper conveyor according to claim 1 wherein said means includes a spring (35) which is much weaker than the spring means (36) and which is intended to pivotally bias the movable clamping jaw (33) in its opening direction.

5. A gripper conveyor according to claim 1 wherein the maneuvering arm (37) is mounted with a limited freedom of movement in the pivotal direction relative to a shaft (32) which carries the movable clamping jaw (33); and wherein a spring (35) which is weaker than the spring means (36) is intended to bear against the maneuvering arm (37) in a manner to swing said arm outwards away from the pivotal clamping jaw (33) in the gripping position of said jaw.

6. A gripper conveyor according to claim 5, wherein the relatively weak spring (35) which functions to swing the maneuvering arm (37) to its outwardly swung position is the same spring (35) as that which biases the pivotal clamping jaw (33) towards its outwardly swung position.

7. A gripper conveyor according to claim 5 wherein the angle through which the maneuvering arm (37) swings in relation to the movable clamping jaw (33) is at least equally as large as the maximum permitted opening angle between the clamping jaws (31, 33) of the gripper.

8. A gripper conveyor according to claim 1, comprising a dogging means (38; 130) by means of which the maneuvering arm (37) is able to dog the movable clamping jaw (33) to its open position.

9. A gripper conveyor according to claim 8, wherein the spring means (36) acts towards the dogging means.

10. A gripper conveyor according to claim 8, wherein the dogging means is fixedly connected to the movable clamping jaw or to the maneuvering arm.

11. A gripper conveyor according to claim 8, wherein the dogging means is journalled for limited pivotal movement, preferably on the pivot shaft of the clamping jaw, relative to the maneuvering arm and the pivotal clamping jaw.

12. A gripper conveyor comprising a moving conveyor chain (1) which is provided with grippers (3) each including a fixed clamping jaw (31), a pivotable clamping jaw (33) and a spring means (36) which functions to bias the grippers towards a closed state, and an opening means (6, 41, 42, 68) for opening selected grippers (3) as the conveyor chain (1) moves, wherein the pivotable jaw (33) of the grippers (3) is connected to a maneuvering arm (37) which can be swung by the opening means in a direction such as to dog the pivotable clamping jaw towards its open position against the action of the spring means, wherein the pivotable clamping jaw (33) is mounted on a pivot in order to be substantially freely swingable on the pivot in order to drop to the open state of the gripper and for limited pivotal movement in relation to the pivotal maneuvering arm (37) in the open state of the gripper; and wherein means (331; 35) are provided for driving the movable clamping jaw (33) towards its outer end position in the pivot direction in the opening actuating state of the maneuvering arm (37), wherein the arm (37) is mounted with a limited freedom of movement in the pivotal direction relative to a shaft (32) which carries the movable clamping jaw (33); and wherein a spring (35) which is weaker than the spring means (36) is intended to bear against the maneuvering arm (37) in a manner to swing said arm outwards away from the pivotal clamping jaw (33) in the gripping position of said jaw, wherein the opening means includes means (68, 41, 42; 6') for opening an individual gripper independently of adjacent grippers, and a guide bar whose length exceeds the division or spacing between the grippers (3) on the chain (1) and extends parallel with said chain, and wherein the bar (400) supports the end of the maneuvering arm of the opened gripper while sliding along the bar (400).

* * * * *